US005957178A

United States Patent [19]

Arasmith

[11] Patent Number: 5,957,178

[45] Date of Patent: Sep. 28, 1999

[54] METHOD AND APPARATUS FOR PROCESSING PAN-SHAPED WOOD MEMBERS

[76] Inventor: Stanley Dale Arasmith, P.O. Box 2458, Rome, Ga. 30164

[21] Appl. No.: 08/995,453

[22] Filed: Dec. 22, 1997

Related U.S. Application Data

[60] Provisional application No. 60/066,215, Nov. 20, 1997.

[51] Int. Cl.[6] ..... B27C 1/00; B27B 1/00; B02C 19/00

[52] U.S. Cl. ..... 144/373; 144/162.1; 144/242.1; 144/245.1; 144/172; 144/174; 241/282

[58] Field of Search ..... 144/162.1, 163–165, 144/172, 173, 174, 180, 242.1, 245.1, 245.6, 363, 373; 241/280, 282

[56] References Cited

U.S. PATENT DOCUMENTS

| | | | |
|---|---|---|---|
| 3,195,594 | 7/1965 | Bloomquist et al. | 144/172 |
| 3,688,997 | 9/1972 | Ullner | 241/282 |
| 3,690,568 | 9/1972 | Alexander | 241/282 |
| 4,305,590 | 12/1981 | Haikkala et al. | 241/282 |
| 4,444,234 | 4/1984 | Arasmith . | |
| 4,569,380 | 2/1986 | Arasmith . | |
| 4,595,150 | 6/1986 | Aario | 241/282 |
| 4,697,626 | 10/1987 | Arasmith . | |
| 4,776,375 | 10/1988 | Arasmith . | |
| 4,785,860 | 11/1988 | Arasmith . | |
| 4,874,024 | 10/1989 | Arasmith . | |
| 5,070,918 | 12/1991 | Pallmann | 144/172 |

FOREIGN PATENT DOCUMENTS

| | | | |
|---|---|---|---|
| 16931 | of 1890 | United Kingdom | 144/174 |

*Primary Examiner*—W. Donald Bray
*Attorney, Agent, or Firm*—Jones & Askew

[57] ABSTRACT

A method and apparatus for reducing the size of wood members, particularly pan-shaped wood members known in the industry as "lilypads", such that the orientation of the fibers of the lilypads are encouraged to be substantially perpendicular to the longitudinal and rotation axis of a cutting drum having a plurality of cutting members extending from its circumferential surface.

24 Claims, 17 Drawing Sheets

METHOD AND APPARATUS FOR PROCESSING PAN-SHAPED WOOD MEMBERS

CROSS REFERENCE TO RELATED APPLICATION

This application claims the benefit of U.S. Provisional Application Ser. No. 60/066,215 filed Nov. 20, 1997.

TECHNICAL FIELD

This invention relates in general to materials processing, particularly relates to wood processing, and most particularly relates to the processing of relatively flat pan-shaped "cut-off" members sometimes known in the industry as "lilypads", which are provided when the ends of logs are "squared off" prior to further log processing.

BACKGROUND OF THE INVENTION

Wood and other material processing apparatuses and methods have been used for many years. In the instance of wood processing, methods and apparatuses including my U.S. Pat. Nos. 4,444,234, 4,569,380, 4,697,626, 4,776,375, 4,785,860, 4,874,024, (incorporated herein by reference) have been used for great benefit in both debarking, cutting, and "hogging" various wood elements, ranging from rock-laden wood processing "hogs" to specialized "knives" used to provide particular wood shavings.

Although such methods and apparatuses have been generally suitable for the tasks with which they are assigned, a new need in the industry has arisen for a suitable means for handling wood "lilypads", which in certain instances can be provided in large quantities, such as in the case of large wood processing facilities.

Due to the scarcity and cost of timber, wood processing facilities ("mills") have reduced waste by cutting logs more accurately. This is reflected in the creation of much shorter "trim-ends" than were previously cut. These trim-ends are approximately 3 inches and shorter, and have been come to be known as "lilypads".

These lilypads are created when the ends of logs are trimmed to provide an end cut which is substantially "square". These "lilypads" get their names from their appearances, which are substantially flat and disclike, and include lengths being substantially shorter than their diameters.

Prior art apparatuses have not been able to suitably process such wood elements, and tend to "shatter" them due to misalignment of the wood grain relative to the cutting edge as discussed in further detail below. Therefore the mills have instead used the lilypads for fuel by burning. However, there is a surplus of such matter, and burning has been found to pollute the atmosphere. Many scientists claim such burning has reached a critical level and certain governments have correspondingly placed restrictions or controls on such burning.

Therefore there is a need in the art for a method and apparatus for handling bulk quantities of lilypads, which will process the lilypad members in an efficient yet effective manner, providing wood chips having desirable characteristics for pulp and paper chip use. Methods and apparatuses are always needed which produce a high quality wood chip, with lower power requirements, which convert waste product to a high dollar item which is recyclable and non-polluting.

SUMMARY OF THE INVENTION

The present invention overcomes deficiencies in the prior art by providing a method and apparatus for processing lilypad wood members which can handle a large number of lilypad members either sequentially or in batches, with the lilypad members being processed by cutting members to provide wood chips having desired and consistent characteristics.

Generally described, the present invention provides an apparatus for reducing the size of wood members, the apparatus comprising a drum rotatable about a longitudinal axis, a cutting member attached to the drum, a hopper including a floor and at least one side wall, a lower reciprocating pusher member configured for reciprocating movement from a retracted position to an extended position, and an upper pusher member configured for movement relative to the lower member and the frame such that the upper member extends above and overhangs the lower member to define a moving cavity.

Therefore it is an object of the present invention to provide an improved material processing apparatus.

It is a further object of the present invention to provide an improved wood processing apparatus.

It is a further object of the present invention to provide an apparatus for processing disclike wood members, sometimes referred to as "lilypads".

It is further object of the present invention to provide a chipping action on a disclike "lilypad" member which is similar to the desired chipping action as if a log was parallel to the longitudinal axis of the chipper drum.

It is a further object of the present invention to provide an apparatus for processing wood members which includes a "moving pocket", which retains the wood members in a desired orientation as the wood members are consumed by a cutting drum.

It is a further object of the present invention to provide an apparatus for processing disclike wood members having a wood grain substantially shorter than the longest dimension of said wood members.

It is a further object of the present invention to provide an improved method for processing wood.

It is further object of the present invention to provide an improved method for processing disclike wood members.

Other objects, features, and advantages of the present invention will become apparent upon reading the following detailed description of the preferred embodiment of the invention when taken in conjunction with the drawing and the appended claims.

BRIEF DESCRIPTION OF THE DRAWINGS

FIG. 9A shows the tipper plate 40 tipping a lilypad member 50A over, and then retracting to the position shown in FIG. 9B. In FIG. 9B a second lilypad member 50B slides from atop the inclined wall 34 to atop the upper pusher plate 40, until is it later pushed off by the tipper plate 90 or by the stationary inclined wall 32 upon full retraction of the upper pusher plate 40.

FIG. 10A shows a wood lilypad member 50A in the hopper with all four plates 140, 160, 40', and 60' fully retracted. FIG. 10B shows the two lowermost "primary" pusher plates 40', 60', fully extended (thus causing the wood lilypad member 50A to be consumed). At this point, a second lilypad member 50B has been dropped into the hopper and atop the fully-extended upper pusher member 40'. FIG. 10C shows the upper and lower "fsecondary" pusher plates 140, 160, as they are extended towards the cutting drum (by a single hydraulic cylinder), pushing and containing the wood lilypad member 50B. FIG. 10D shows all four of the pusher plates 140, 160, 40' and 60' fully extended. It should be understood that all four plates could be simultaneously retracted.

FIGS. 12A–12C show side, leading end, and top views, respectively, of a cutting knife 12 according to the present invention. As may be seen, such a configuration includes a main cutting edge 13m (including three shown serrations), a pair of cutting wings 13w and three cutting faces 13f.

DETAILED DESCRIPTION OF THE PREFERRED EMBODIMENT

Reference is now made to the drawings, in which like numerals designate like elements throughout the several views.

General Construction and Operation

Generally described, one embodiment of the present invention includes the use of at least two substantially horizontal "pusher plates", which are each slidably movable relative to an apparatus including a stationary floor and a horizontal-axis cutting drum. Disclike wood "lilypads" are dropped via conveyor or other suitable means onto the floor, and the two pusher plates are urged towards the lilypads and eventually cause at least some of them to be urged into contact with the cutting drum and to be consumed thereby. The relative positioning of the two plates as they come into the vicinity of the lilypad is important; the upper pusher plate overhangs the other such that a "moving pocket" is defined which tends to capture the disclike members in a desired orientation as they contact the cutting drum.

The Desired Orientation

Figure 1:
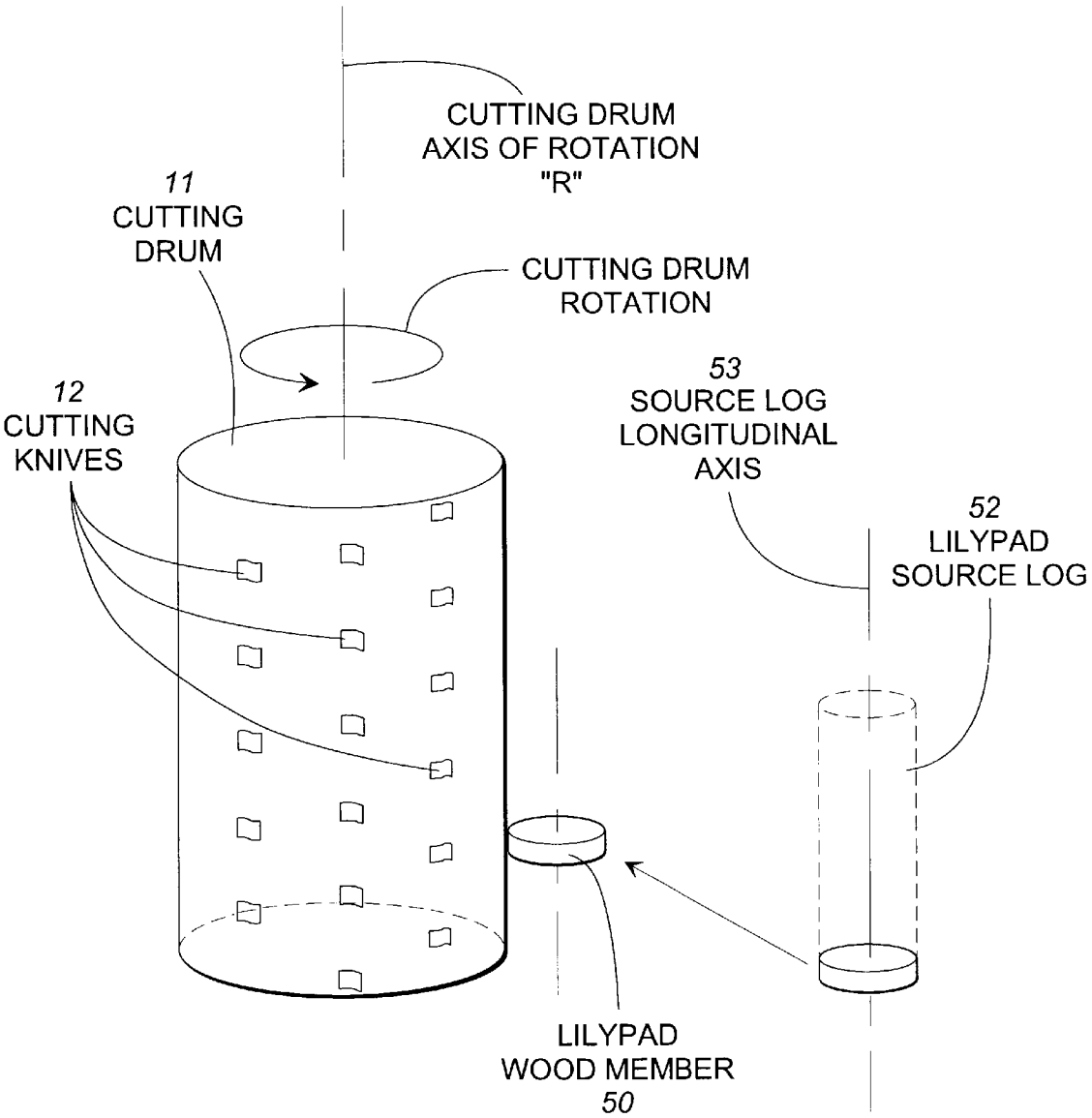
FIG. 1 is a pictorial illustrative view of an isolated cutting drum 11 having cutting knives 12 mounted thereon. The cutting drum 11 rotates about a substantially vertical axis of rotation "R", such that a lilypad wood member 50 is consumed by the cutting knives. The lilypad wood member 50 is oriented during the during cutting process as if it was part of an elongate log 52 and the longitudinal axis of the log is parallel to the rotational axis of the cutting drum.

Reference is first made to FIG. 1, to illustrate the manner in which the lilypad wood members 50 are oriented relative to a rotating cutting drum 11. FIG. 1 is a pictorial illustrative view of an isolated cutting drum 11 having cutting knives 12 mounted thereon. The cutting drum 11 rotates about a substantially vertical axis of rotation "R", such that a lilypad wood member 50 is captured within a pocket is consumed by the cutting knives. The lilypad wood member 50 is oriented the during cutting process as if it was part of an elongate log 52 and the longitudinal axis of the log is parallel to the rotational axis of the cutting drum.

As may be seen, lilypad wood members such as 50 are typically cut from the ends of typical elongate wood members such as a source log 52. As is well known, the wood grain of such source logs runs along the longitudinal axis of the log. In the wood processing art, it has become known to process such logs with prior art knives or other suitable cutting members when the longitudinal axis 53 of the source log 52 is substantially parallel to the longitudinal and rotational axis of the cutting drum 11. One reason for such desired orientation is due to the fact that such elongate log members lend themselves well to a "cradling" effect in which the log is cradled between the cutting drum and a stationary wall or anvil such as shown in my U.S. Pat. No. 4,785,860, or similarly cradled between a cutting drum and a plurality of toothed wheels drum as shown in my U.S. Pat. No. 4,444,234.

However, as noted above, as more accurate wood processing techniques have been developed, less waste is involved (the low-end trim is much shorter) and therefore there is more of a tendency to create "lilypads" such as 50 in FIG. 1, with the average length of the lilypads (also known as cut-offs") being approximately 3" thick×6"–36" in diameter, although other dimensions are contemplated.

Therefore, it may be understood that the desired chipping action is similar to the desired chipping action as if a log was parallel to the longitudinal axis of the chipper drum, in that cutting is preferably done by slicing "along the log", which takes less horsepower than if cutting with the end grain facing the drum.

Two-Plate Design Construction

As noted above, the wood lilypads must be oriented correctly to make an acceptable chip. It has been determined that there is difficulty in orienting "lilypad" elements, due to their relatively short fiber length.

Figure 2:
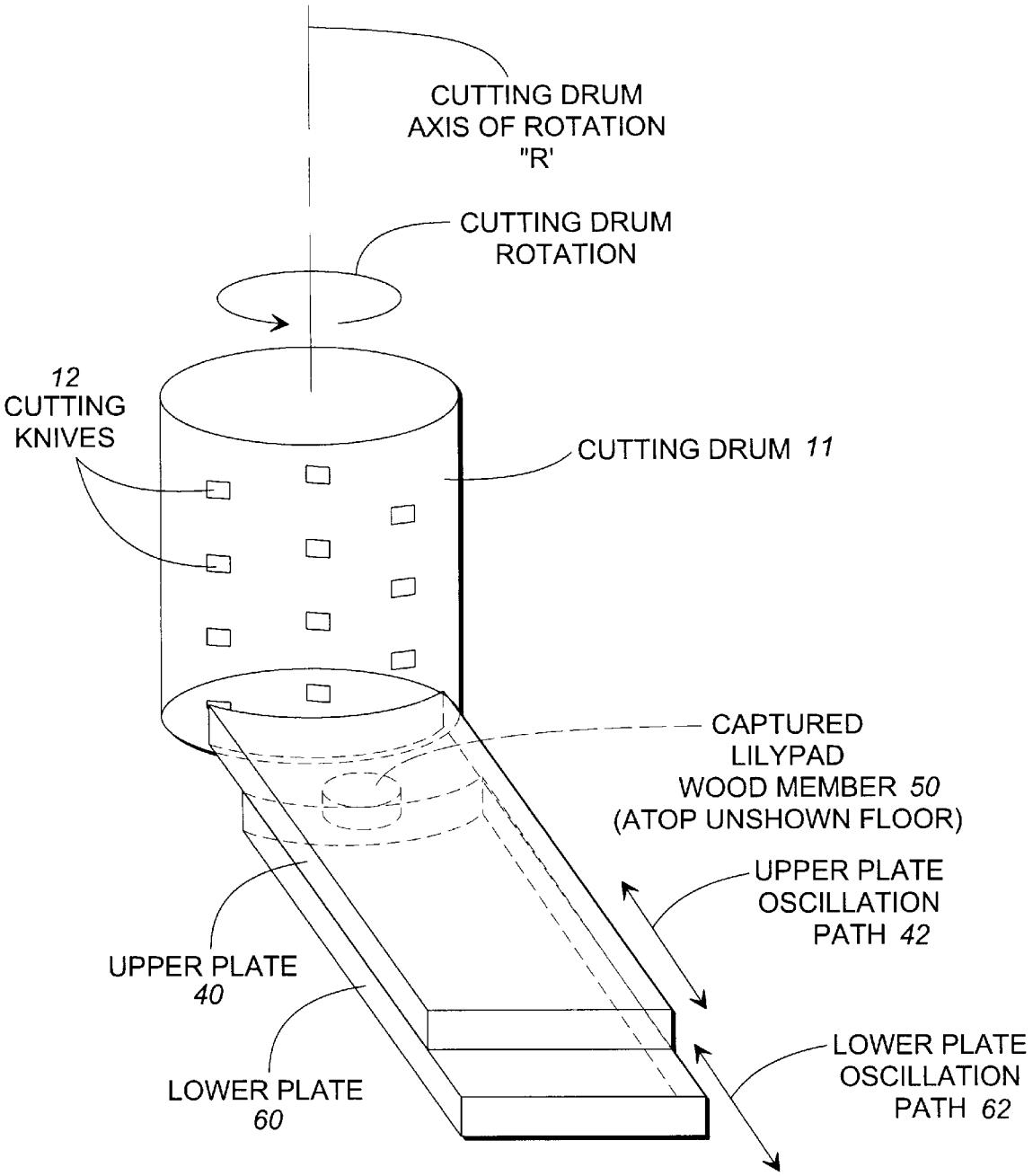
FIG. 2 is a pictorial view of an isolated cutting drum 11 (having a cutting drum axis of rotation "R") shown relative to a lilypad wood member 50 as it is guided towards the circumferential surface of the cutting drum by an upper pusher plate 40 and a lower pusher plate 60. The respective oscillation paths 42, 62, of the upper and lower pusher plates 40, 60, are also shown.
Figure 3:
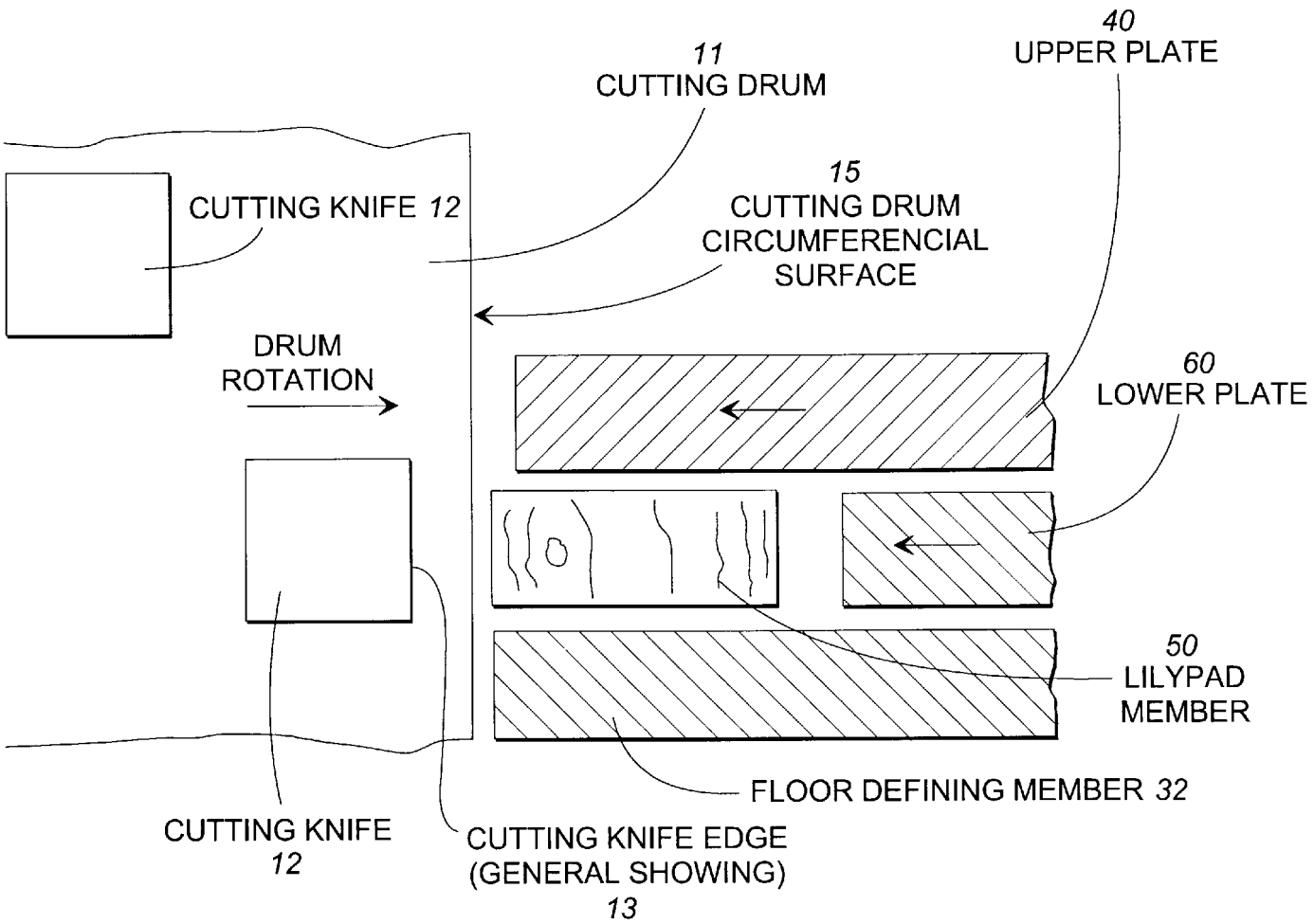
FIG. 3 is side, partial cross-section view of a portion of the apparatus according to the present invention, showing a lilypad wood member 50 (not in cross section) being captured within a pocket defined by the upper and lower pusher plates 40, 60 and the floor defining member 32 (all three shown in cross section ), as the lilypad member is urged leftwardly towards the cutting drum 11 (a portion of which is shown but not in cross section). The cutting edges 13 of the cutting knifes 12 are shown generally for illustrative purposes in FIG. 3; more details of the cutting edges are shown in, for example, FIGS. 12A–12C.

The apparatus according to the present invention achieves such an orientation. Reference is now made to FIG. 2.

FIG. 2 is a pictorial view of an isolated cutting drum 11 (having a cutting drum axis of rotation "R") shown relative to a lilypad wood member 50 as it is guided towards the circumferential surface of the cutting drum by an upper pusher plate 40 and a lower pusher plate 60. The respective oscillation paths 42, 62, of the upper and lower pusher plates 40, 60, are also shown.

The lower pusher plate 60 is configured to slidably move in a reciprocating fashion relative to the frame of the apparatus 10. The upper pusher plate 40, in one preferred embodiment, rests atop the lower pusher plate 60, although as discussed later in this application, the upper pusher plate 40 is configured to slide relative to the lower pusher plate 60, as well as to slide relative to the frame of the apparatus 10. A sliding connection may be made by conventional means known in the art. In the case of the present invention, the sliding connection may be provided by the use of elongate bearing strips made of moly filled nylon or other prior art materials.

As described later in further detail, the upper and lower pusher plates 40, 60, each move in a reciprocating manner along substantially horizontal and parallel travel axes. The paths of each of these pusher members are essentially the same length, beginning from a "retracted" position, and ending at a "extended" position.

The lower pusher plate is powered by a hydraulic cylinder. However, the upper pusher plate 40 is not powered, but instead rests atop and slides along with the lower pusher plate unless an outside force or object is encountered to overcome friction between the two plates 40, 60, as discussed elsewhere.

Two-Plate Design Operation

Operation of the apparatus is now discussed in reference to FIGS. FIGS. 4A–4E, which are sequential side views showing various stages of a complete operating cycle of a two-plate system, showing an upper pusher plate 40, a lower pusher plate 60, a lilypad 50 member being consumed, and a chipping drum 11 consuming the lilypad member 50.

Operation of the apparatus is as follows. Referencing first FIG. 4A, "lilypad" wood members such as 50 are dropped into the hopper onto the floor 32 from a conveyor or other suitable means. The wood members can be dropped in one by one, or in bulk as desired.

Figure 4A:
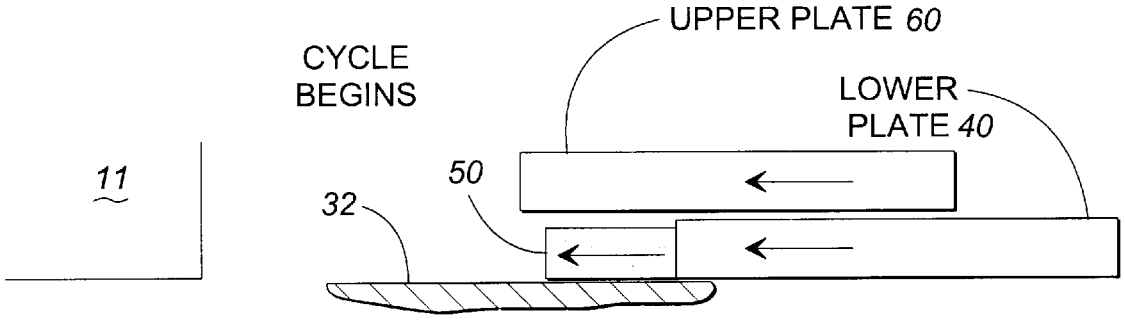
FIGS. 4A–4E are side views showing various stages of a complete operating cycle of a two-plate system, showing an upper pusher plate 40, a lower pusher plate 60, a lilypad 50 being consumed, and a chipping drum 11 doing the consuming.

The upper and lower pusher plates 40, 60, begin their cycle from their positions shown in FIG. 4A. A hydraulic cylinder (not shown in FIGS. 4A–4E) attached between the lower pusher plate and the frame of the overall apparatus is then energized, forcing the lower pusher plate 60 to be urged towards an extended position. The upper pusher plate 40, which rests atop the lower pusher plate 60, is pushed along with the lower pusher plate due to the influence of friction between the two plates 40, 60. During this "infeed" stroke, the upper pusher plate 40 extends beyond the lower pusher plate, causing a cavity 51 (see FIG. 4E) to be provided underneath the overhanging upper pusher plate 40. This cavity 51, which is eventually closed of and eliminated, is an important feature of the present invention and will be discussed in later detail.

Figure 4B:
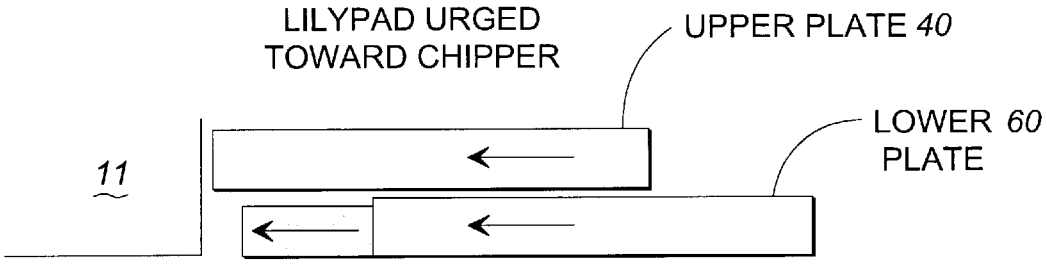
Figure 4C:
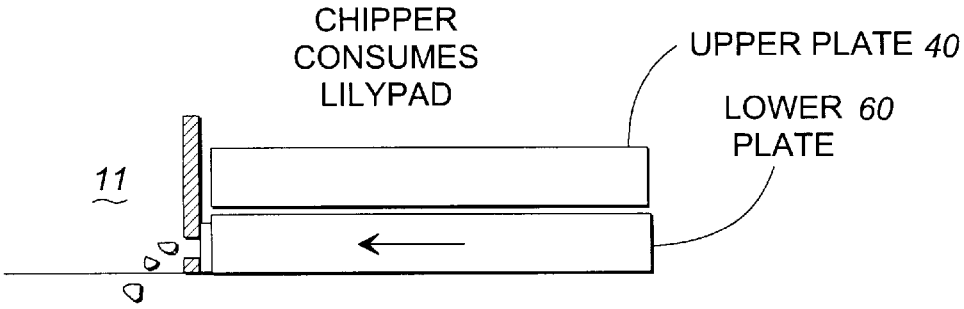

As the upper pusher plate 40 nears the end of its stroke, it approaches a stationary stop member (not shown). The upper pusher plate 40 contacts the stationary stop, and is itself stopped from further travel, to remain in the position shown in FIG. 4B. This is the fully "extended" position of the upper pusher plate 40. However, as shown in FIGS. 4A–C, the lower pusher plate 60 continues its travel, closing the cavity 51 provided by the upper pusher member until the lower pusher plate 60 travels to a desired position until it reaches a microswitch (not shown), which causes its travel to be reversed. At the instant of such travel reversal, the lower pusher plate 60 is at its fully "extended" position, which is shown in FIG. 4C.

At the point shown in FIG. 4C at which the lower pusher plate 60 reverses its position from its "extended" position, it may be understood that both of the upper and lower pusher plate 40, 60 are fully extended. At this time, their arcuate leading edges are in close proximity to the outer, circumferential, surface of a cutter drum, which in the preferred embodiment includes a plurality of cutting knives such as known in the art.

Figure 4D:
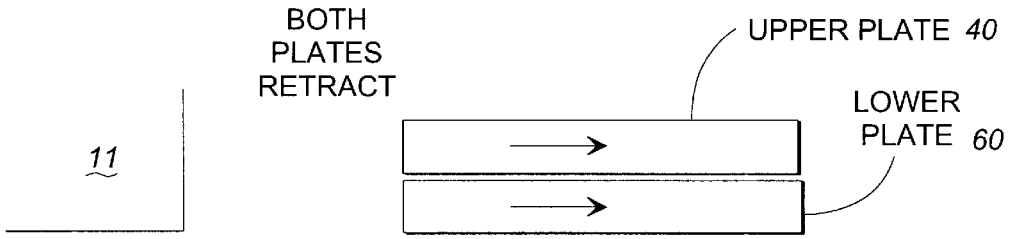

After both have been completely extended, the upper and lower pusher plates 40, 60, reverse their direction and more together to the positions shown in FIG. 4D under the influence of the double-acting hydraulic cylinder. As before, the upper pusher plate 40, which rests atop the lower pusher plate 60, is drawn backward along with the lower pusher plate due to the influence of friction between the two plates 40, 60.

Figure 4E:
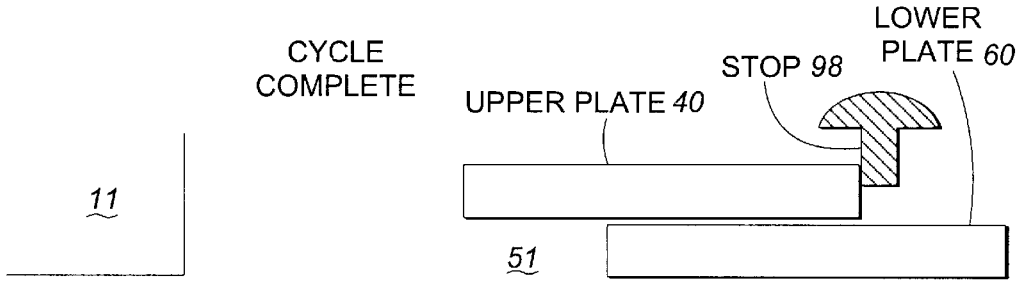

As the two plates 40, 60, continue to be drawn backward, the upper plate 40 contacts a stationary stop 98, which causes the upper pusher plate to stop at its fully retracted position shown in FIG. 4E. However, the bottom pusher member 60 is moved further rearwardly (against the frictional force between the members 40, 60) to its final position shown in FIG. 4E.

Upon complete retraction of the upper and lower pusher plates 40, 60, more wood members can fall upon the horizontal sliding floor surface of the hopper. The pusher plates 40, 60 then again move from their retracted to their extended positions. The wood members 50 are then consumed by the cutting drum 11, with the chips falling within the drum and removed as known in the art.

Figure 5A:
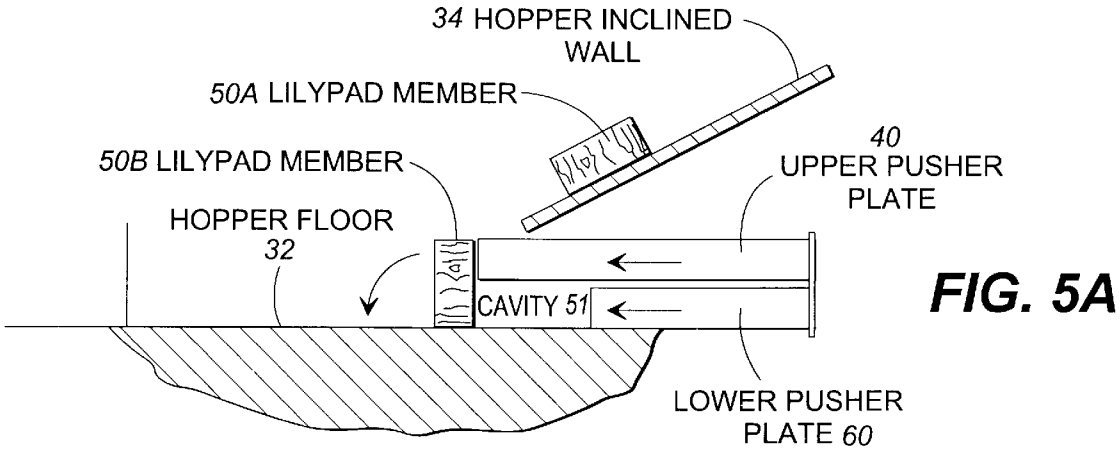
FIGS. 5A–5B are side partial cross-section views of a portion of the apparatus according to the present invention, showing lilypad members 50A, 50B, sliding down an inclined hopper wall 34 of the apparatus 10. Lilypad member SOB is "tipped" over by the upper pusher plate 40, and lilypad member 50B slides off the inclined wall 34 and onto the top of the upper pusher plate 40, although it will be knocked off later into the paths of the members 40, 60, later upon full retraction of the upper pusher plate 40.
Figure 5B:
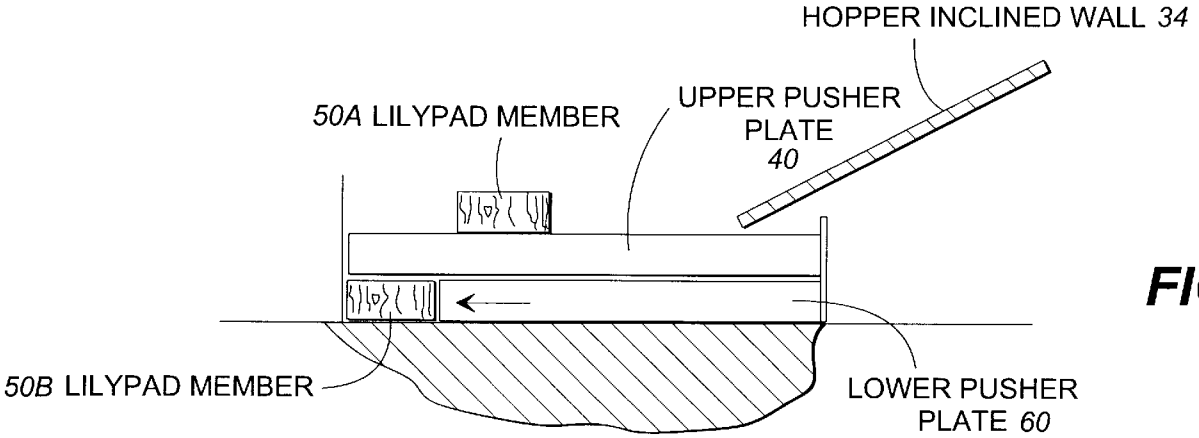

Reference is now made to FIGS. 5A–5B, which are side partial cross-section views of a portion of the apparatus according to the present invention. These figures show lilypad members 50A, 50B, sliding down an inclined hopper wall 34 of the apparatus 10, with one lilypad member 50B being "tipped" over by the upper pusher plate 40, and lilypad member 50B sliding off the inclined wall 34 and onto the top of the upper pusher plate 40, although it will be knocked off later into the paths of the members 40, 60, later upon full retraction of the upper pusher plate 40.

As noted above, the upper pusher plate 40 "leads" the lower pusher plate 60 during the "infeed" stroke. It may be understood that the location of the stop 98 compared to the location of when the lower pusher plate 60 begins its forward motion results in the amount of overhang provided by the upper pusher member 40. It should also be understood that the stroke paths of the two pusher members 40, 60, differ in the amount of the overhang.

Figure 11:
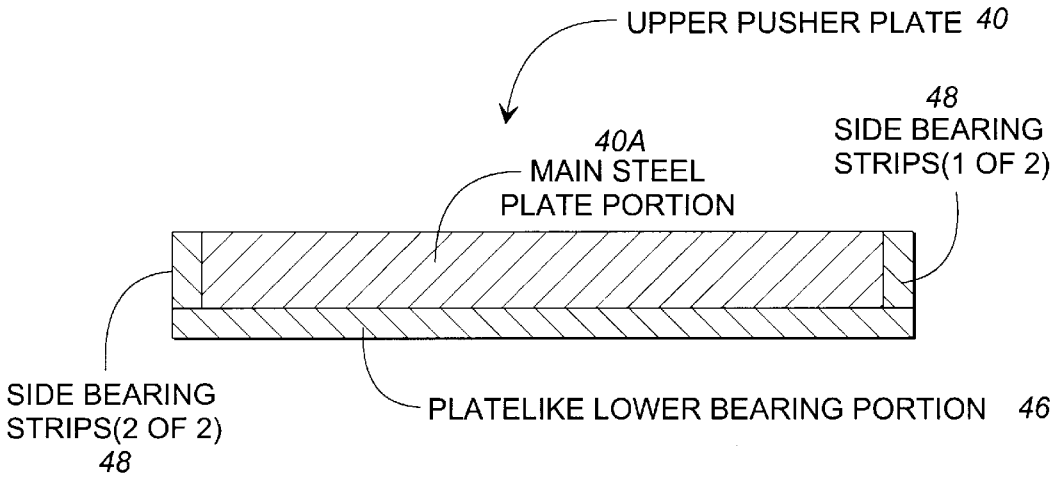
FIG. 11 is a transverse cross section of the pusher plates with upper pusher plate 40 shown by way of example, although this cross sectional configuration is also provided in the lower pusher plate 60 (not shown in FIG. 11). This cross section is taken along a plane normal to the reciprocating travel axis of the upper pusher plate, and shows a platelike metal portion 44, a platelike lower bearing portion 46, and two striplike side bearing portions 48.

FIG. 11 is a transverse cross section of the pusher plates with upper pusher plate 40 shown by way of example, although this cross sectional configuration is also provided in the lower pusher plate 60 (not shown in FIG. 11). This cross section is taken along a plane normal to the reciprocating travel axis of the upper pusher plate, and shows a platelike metal portion 44, a platelike lower bearing portion 46, and two striplike side bearing portions 48.

The upper pusher plate shown in FIG. 11 fits as snugly as possible within available tolerates between the side walls of the hopper, such that the lower bearing plate portion 46 slides upon the upper surface of the lower pusher plate, and the outwardly-facing surfaces of the side bearing portions 48 slide against inwardly-facing surfaces of the hopper. The lower pusher plate 60 slides a similar matter between the walls of the hopper, but its lower surface slides against the floor of the hopper.

As noted elsewhere in this application, molybdenum-impregnated nylon is used as the bearing material for elements 46 and 48.

In one particular embodiment, when the top pusher plate reaches ¾ inches of the drum it is stopped by stops welded or bolted to the sides of the hopper. At this time material less than 3 inches thick (the thickness of the top plate) is trapped below the top pusher; the bottom pusher continues moving toward the chipper drum closing the 9 inch gap until it reaches ¾ inches of the drum. This gives the thin material, (log ends, tie cut offs, etc.), the stability necessary to make a good chip.

In the method discussion above, the two pushers come forward accordingly one at a time until the spikes on both are ¾ inches from the drum, whereupon they all withdraw simultaneously. As discussed later, for higher production and utilizing more knives in the drum, a second set of pushers with a powered pusher could be mounted on top of the first set of pushers.

Two-Plate Design with Tipper

Figure 9A:
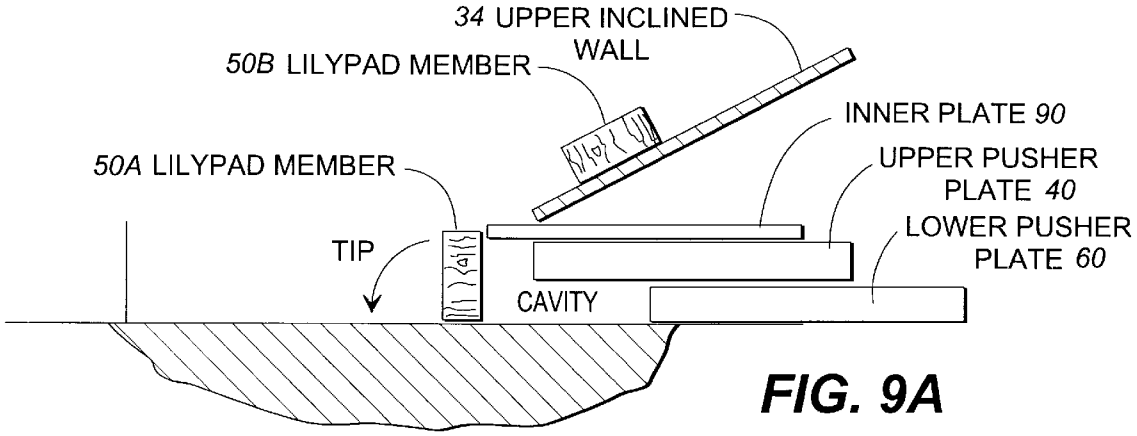
FIGS. 9A–9B are side partial cross sectional views of a portion of a second embodiment of an apparatus according to the present invention, showing a tipper plate 90 used in conjunction with an upper and lower pusher plates 40, 60.
Figure 9B:
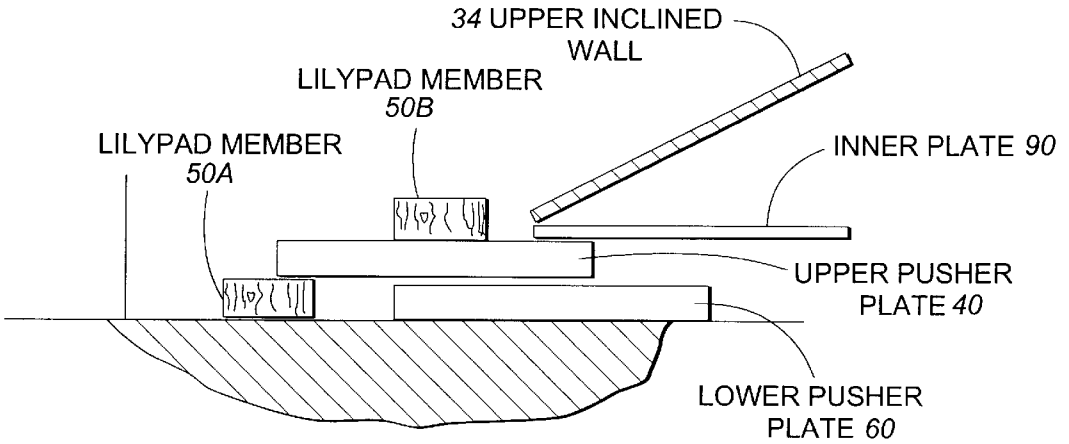
Figure 10A:
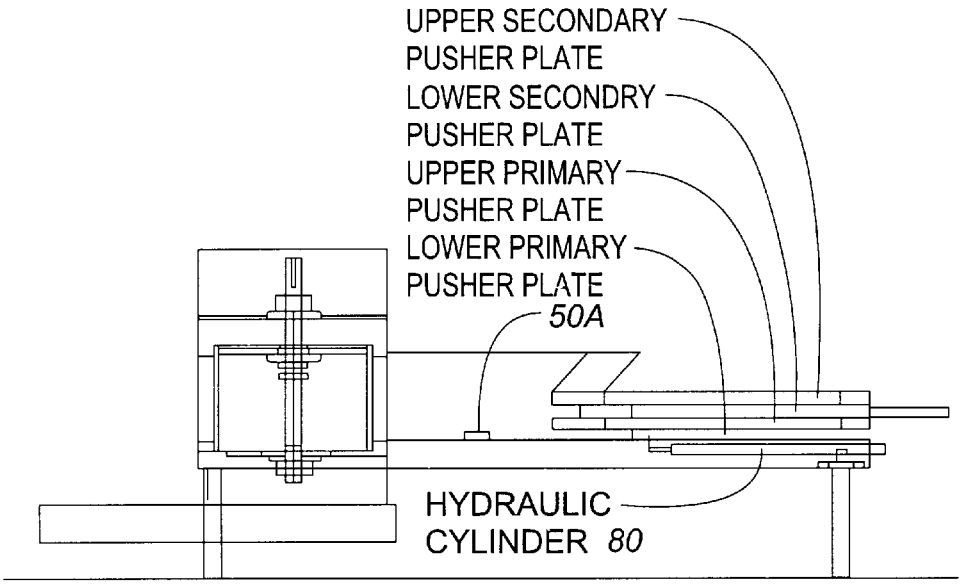
FIGS. 10A–10D are sequential side partial cross-sectional views of a third embodiment of the present invention, showing a four-plate apparatus in operation.
Figure 10B:
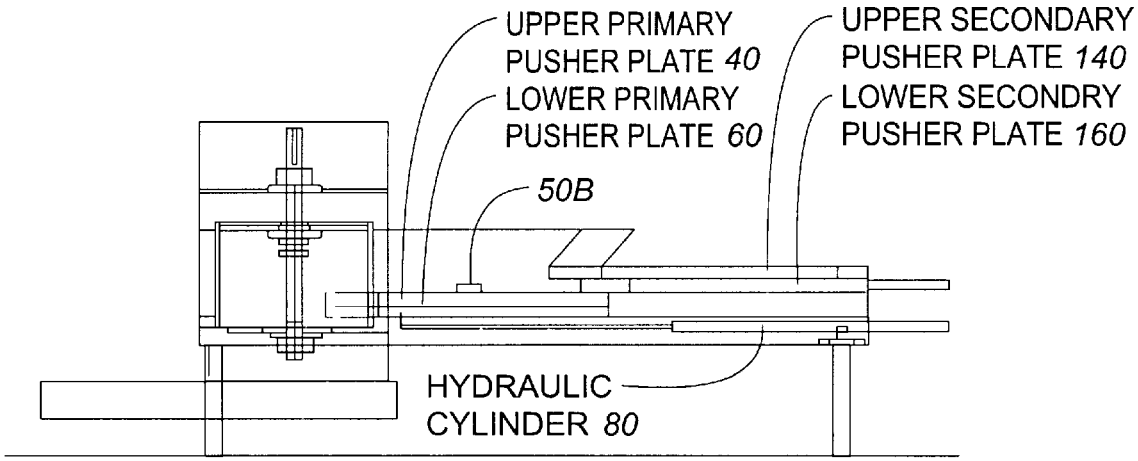
Figure 10C:
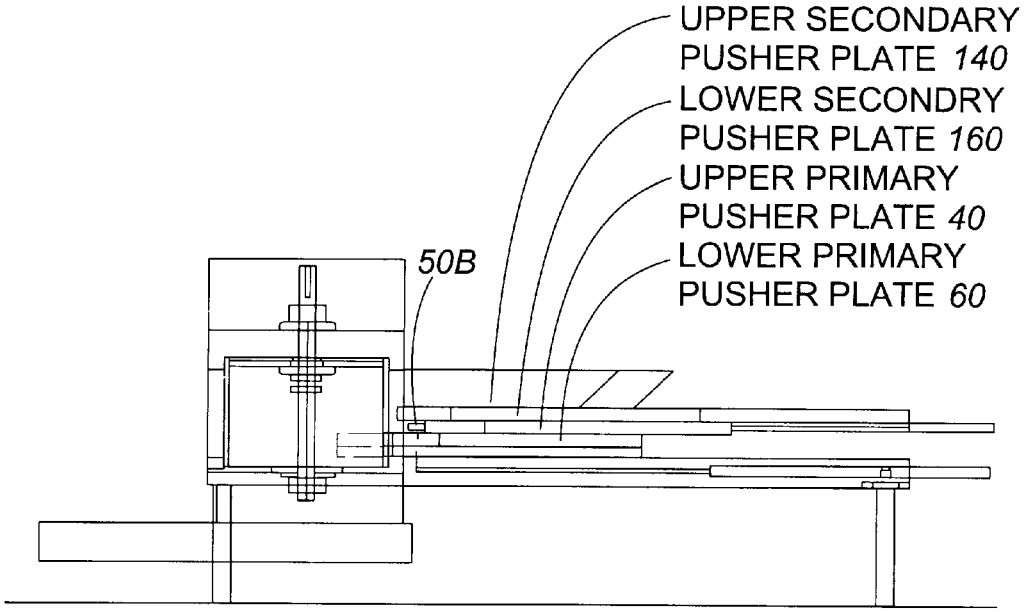
Figure 10D:
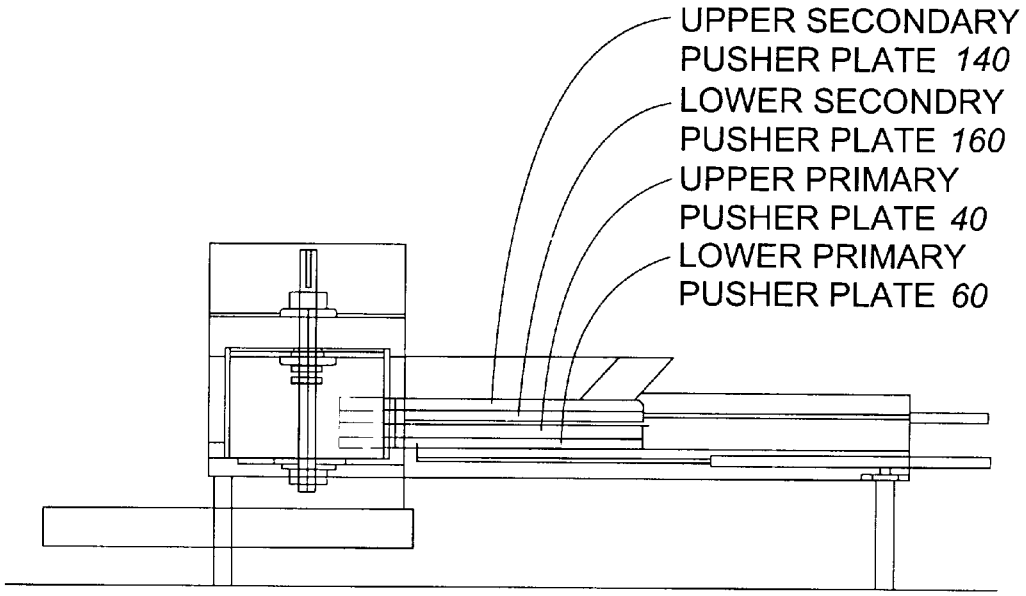

FIGS. 9A-9B are side partial cross sectional views of a portion of a second embodiment of an apparatus according to the present invention, showing a tipper plate 90 used in conjunction with an upper and lower pusher plates 40, 60. FIG. 9A shows the tipper plate 40 tipping a lilypad member 50A over, and then retracting to the position shown in FIG. 9B. In FIG. 9B a second lilypad member SOB slides from atop the inclined wall 34 to atop the upper pusher plate 40, until is it later pushed off by the tipper plate 90 or by the stationary inclined wall 34 upon full retraction of the upper pusher plate 40.

The configuration of FIGS. 9A-9B operates as follows: the tipper plate 90 goes out and back, preferably tipping over lilypads such as the one shown in FIG. 9A. After the tipper plate's retraction, the lower two plates operate as discussed in the design not including the tipper plate described earlier, although some dampening or speed reduction may be provided as discussed later with respect to controls and hydraulics.

Three or More Plate Designs and Methods of Operation

Another alternative to the embodiment is the use of a 3-level configuration, in which an upper pusher element is moved all the way in, and then a middle pusher element is moved all the way in, and then a lower pusher element is moved all the way in. All three can then be retracted.

Another embodiment includes the use of a "pair" of elements which interact similar to the two elements shown in FIGS. 10A–D. In this case, the lower "pair" will conduct the action described above, and then, the upper pair will perform a similar action, with the upper surface of the upper pusher member of the lower pair performing the same service of the floor of the hopper.

If for instance longer blocks are introduced, for example a dia. of 18"×10' long the top pusher will set higher on the block making it more stable. If there were resistance in the chipping process the bottom pusher would automatically be moving forward to assist in the feeding process. The pushers can be different thicknesses depending on average block size.

The top pusher I described is depending on the bottom pusher for movement or power. The bottom pusher is moved by a hydraulic cylinder. The top pusher I will call the non-powered pusher. The non-powered pushers can be stacked several high depending on material length (thickness). The pushers would resemble inverted stair steps to better trap various size material.

Engaging Teeth or "Spikes"

Figures 6A, 6B:
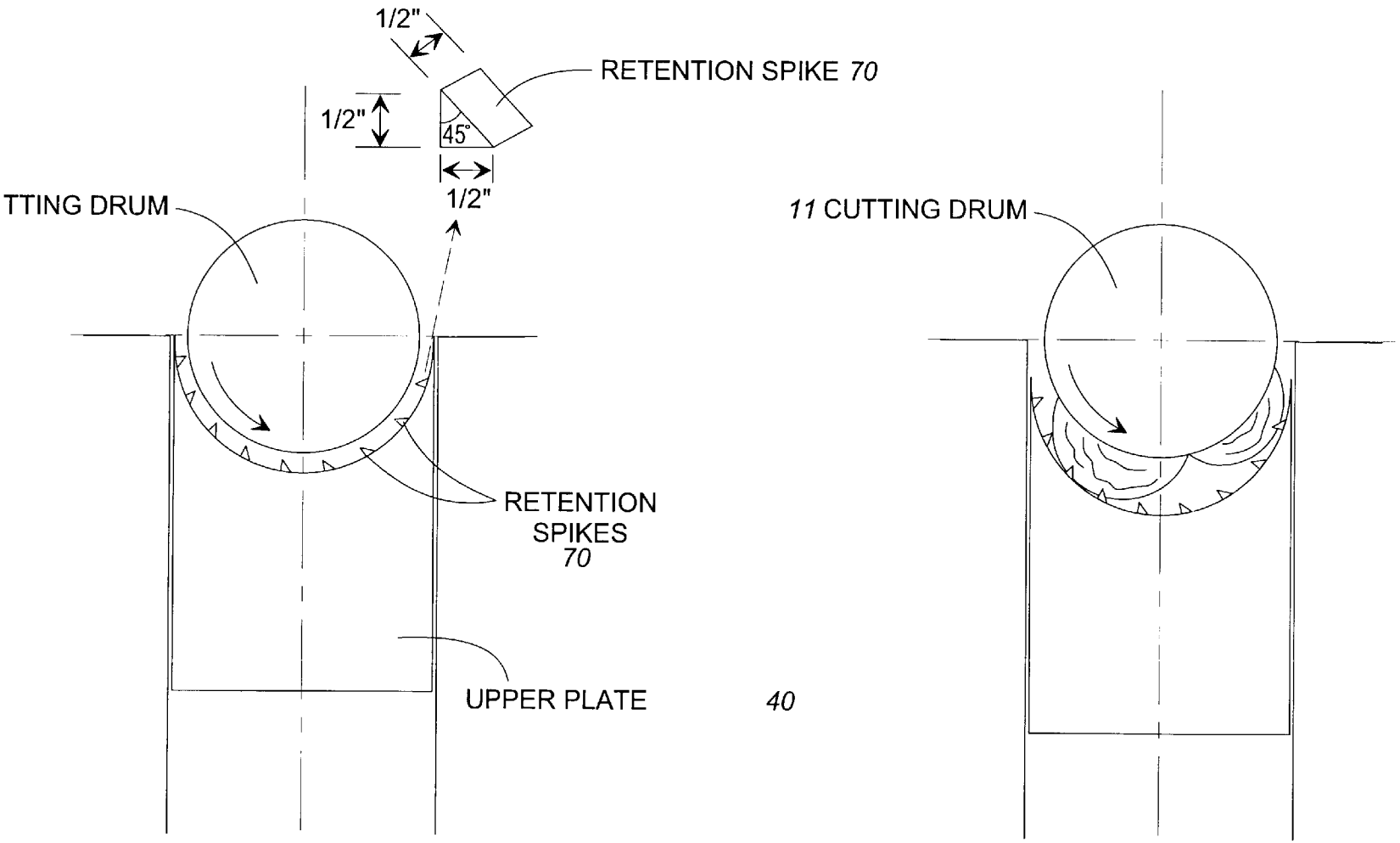
FIGS. 6A and 6B are top illustrative views of an upper pusher plate 40 including retention spikes 70 on its leading edge with FIG. 6A showing the retention spikes 70 not engaging wood, and FIG. 6B showing wood being engaged by the retention spikes.
Figure 7:
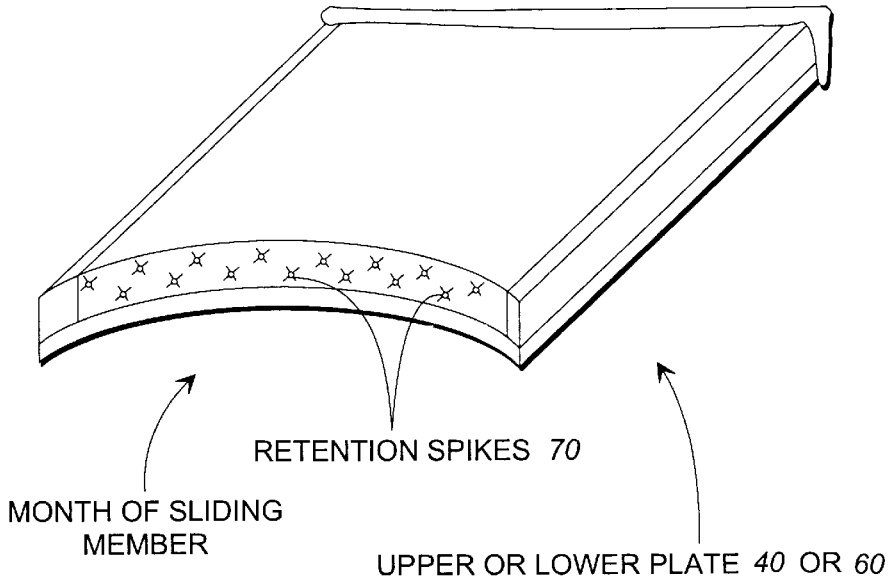
FIG. 7 is a pictorial partial view of the leading arcuate face (also which may be referred to as a leading "edge" or "mouth") of either of the upper or lower pusher plates 40, 60, showing retention spikes used for wood gripping purposes. The arcuate nature of the leading, "pushing", face allows the plate to conform substantially to the circumferential surface of the drum as shown in the other drawings.
Figure 8:
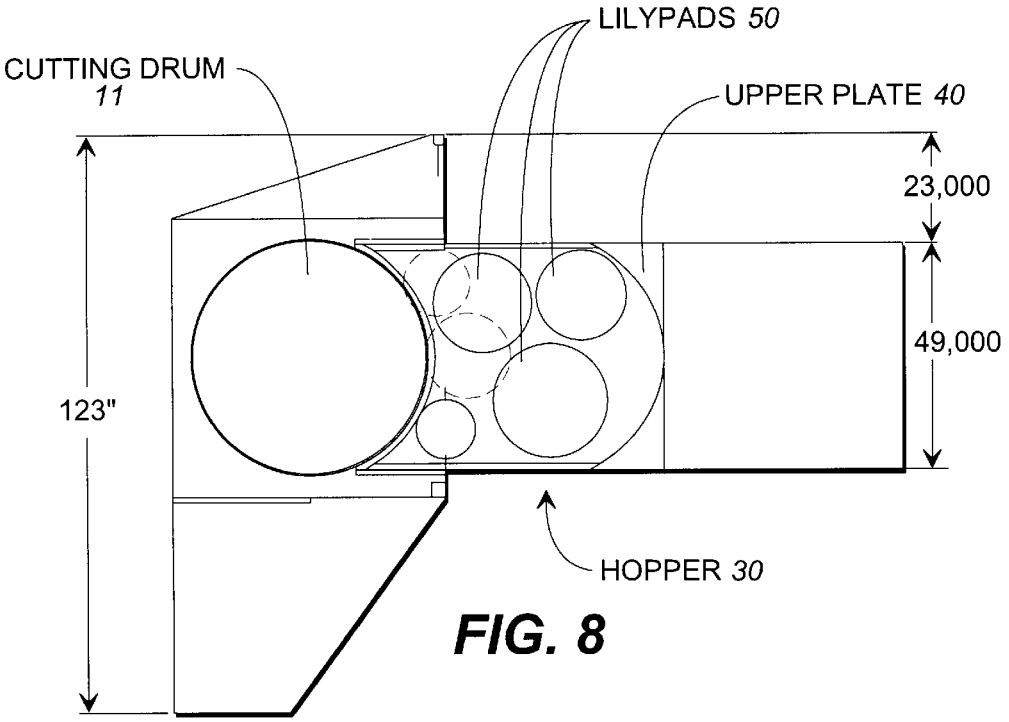
FIG. 8 is a top plan view of the apparatus 10 according to the present invention, showing multiple lilypads 50 within the hopper 30.

Reference is now made to FIG. 7. which shows that the leading arcuate pushing edges of the upper and lower pusher members can include multiple gripping teeth or "spikes" 70, which are attached to the metal portion of the pusher plates and tend to "grip" wood members as they are being engaged by the cutting knives of the drum. These teeth, if used, can be a variety of heights and at various spacing. However, they can be 3–4 inches apart, in two rows, and approximately ¼–½ inches high. FIGS. 6A-6B show the spikes as they are mounted and as they engage and retain the wood members. This retention feature, combined with the feed system used can have a significant impact on power consumption, as cradling and "jamming" of the wood material is discouraged.

Figure 17:
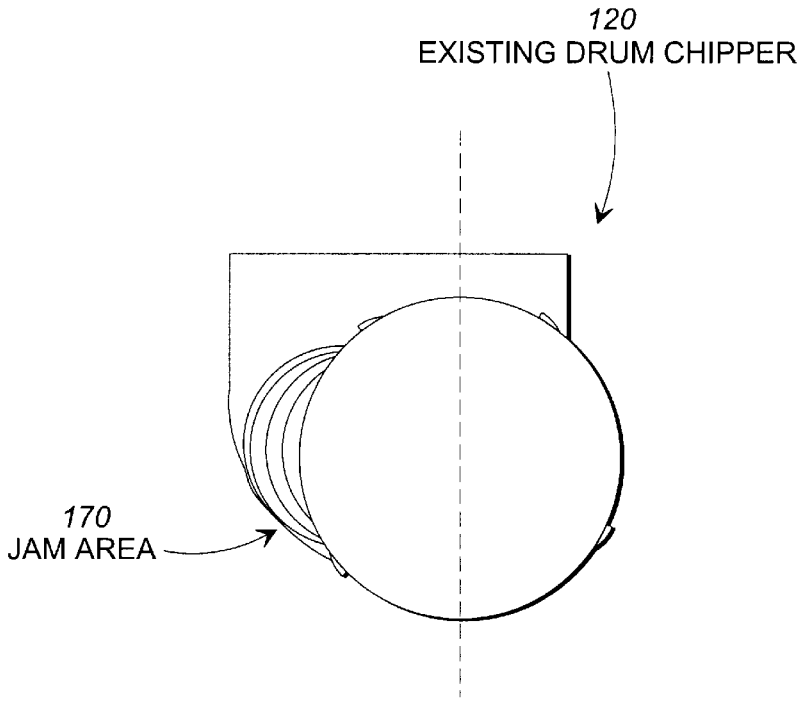
FIG. 17 is an illustration of a prior art chipper 120 showing how such chippers can jam through gravity feeding. Disc chippers (not shown) are also known.

For comparison purposes, a prior art system which includes "crading" is shown in FIG. 17. This system, which includes a horizontal chipper and accepts to logs via gravity drop, encourages cradling, wedging, and, effectively, jamming. As may be understood, such systems do not include the capability of controlled feeding as provided by the present invention, in which feed can be stopped or slowed upon high loading of the chipper drum.

Hopper Configurations

The lilypad members 50 can be conveyed or dropped onto the sloping end of the hopper. This will assist the lilypads in falling flat on the floor of the hopper. The sloped end of the hopper could be made of stainless steel, fiberglass or plastic with a magnet attached to the back of the sloped end to capture tramp metal. Screening holes in the floor of the hopper can be provided for sawdust and other small materials.

If the pusher assembly is made of stainless steel, fiberglass, or plastic, an electro magnet could be installed under the top layer and capture tramp metal. When the pusher is fully retracted the electromagnet can be turned off and an overhead magnet would attract the metal. The pusher's magnet would be turned on when it again enters the working area. In lieu of an overhead magnet, a flap type scraper could also be employed when the magnet is shut off on the return stroke.

As may be seen in for example FIGS. 5A-B, the shape of the chute tends to prevent wood lilypad members from falling atop the upper pusher member, while still providing efficient use of space.

The Knives

Reference is now made to FIGS. 12A–12C, 13, and 14.

Figure 12A:
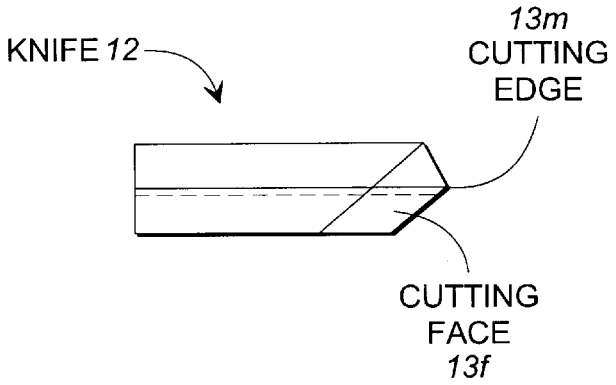
Figure 12A:
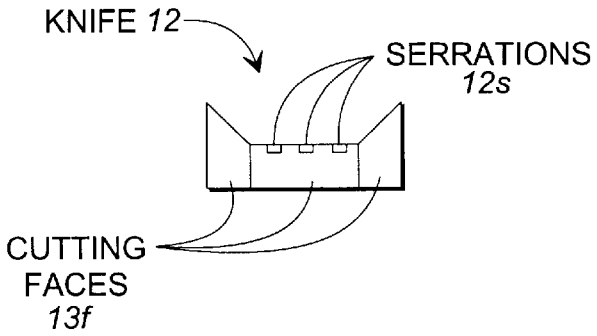
Figure 12C:
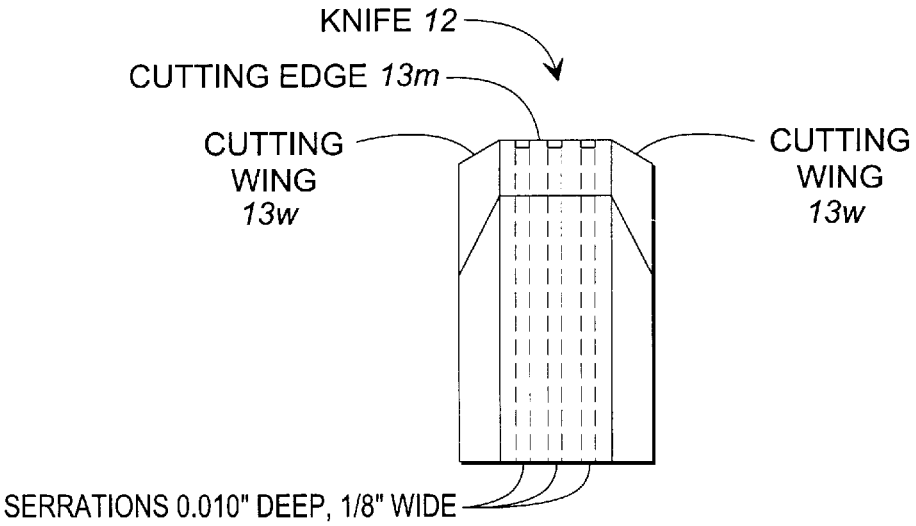

FIGS. 12A–12C show side, leading end, and top views, respectively, of a cutting knife 12 according to the present invention. As may be seen, such a configuration includes a main cutting edge 13m (including three shown serrations), a pair of cutting wings 13w and three cutting faces 13f. Three serrations are shown which are each 0.010 inches deep and ⅛ inches wide. These serrations provide fiber-slitting edges.

Figure 13:
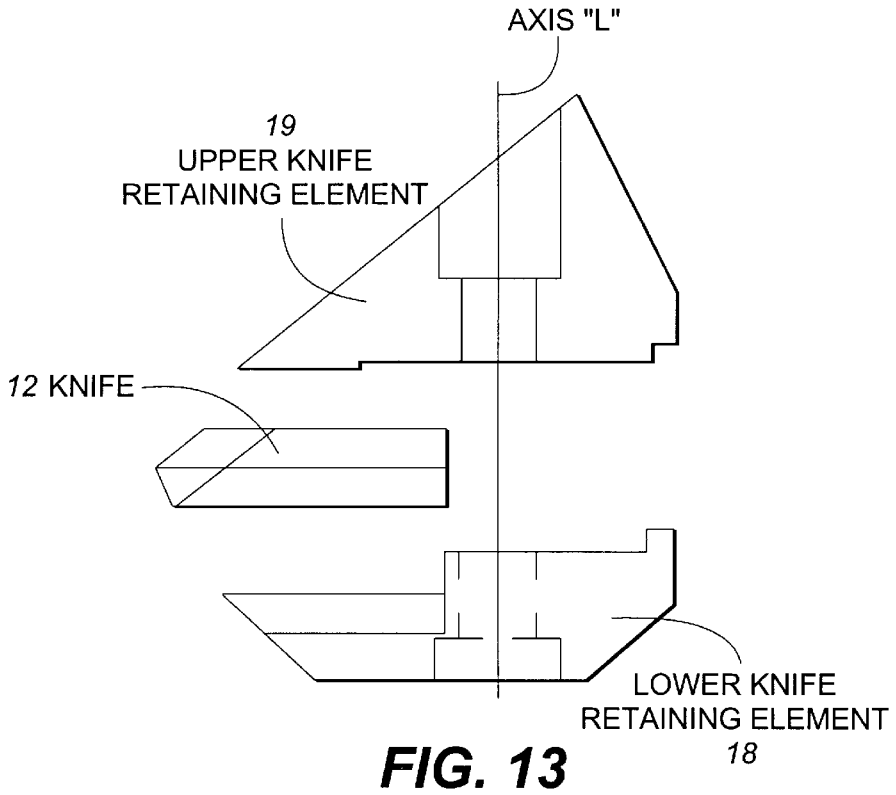
FIG. 13 is an exploded view of a knife assembly including the knife 13 and upper and lower knife retaining elements 19, 18. The lower retaining element 18 is mounted to the cutting drum and the upper element 19 captures the knife 13 and is retained by an unshown bolt having a longitudinal axis along line L.

FIG. 13 is an exploded view of a knife assembly including the knife 13 and upper and lower knife retaining elements 19, 18. The lower retaining element 18 is mounted to the cutting drum and the upper element 19 captures the knife 13 and is retained by an unshown bolt having a longitudinal axis along line L.

Figure 14:
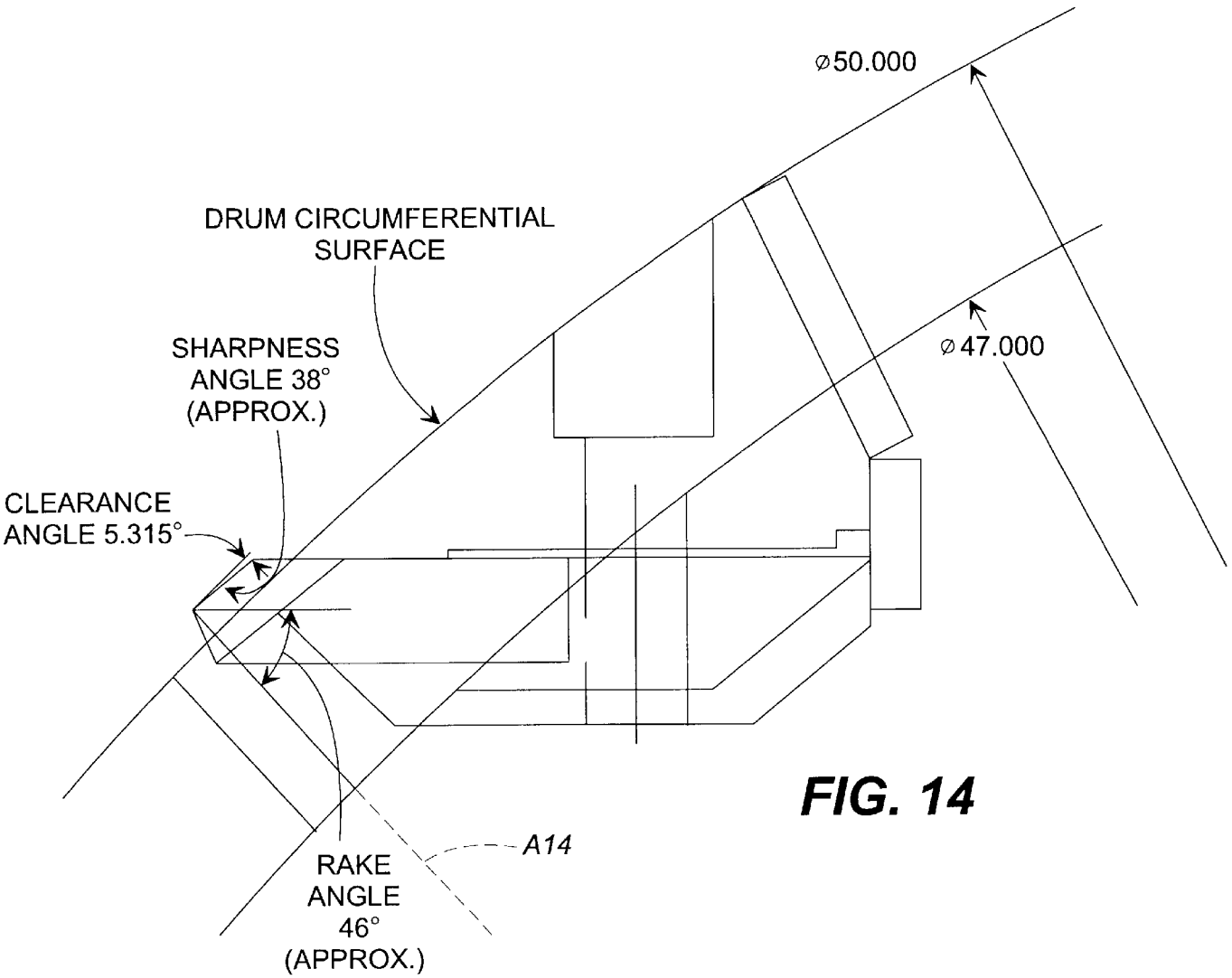
FIG. 14 shows the knife 13 in its mounted position. As may be seen, the sharpness angle of the main cutting edge is approximately 38 degrees, the clearance angle is approximately 5 degrees (5.315 degrees in one particular instance), and the rake angle is approximately 46 degrees. These approximate angles should total to ninety degrees.

FIG. 14 shows the knife 13 in its mounted position. As may be seen, the sharpness angle of the main cutting edge is approximately 38 degrees, the clearance angle is approximately 5 degrees (5.315 degrees in one particular instance), and the rake angle is approximately 46 degrees. These approximate angles should total to ninety degrees.

The Hydraulic Setup

As noted within this description, reciprocating movement of various plates is provided by the use of various hydraulic components, although other drive configurations are contemplated without departing from the spirit and scope of the present invention. However, it has been found advantageous to provide a system which moves more rapidly during its "retraction" stroke(s), as this is essentially machine downtime.

Figure 15:
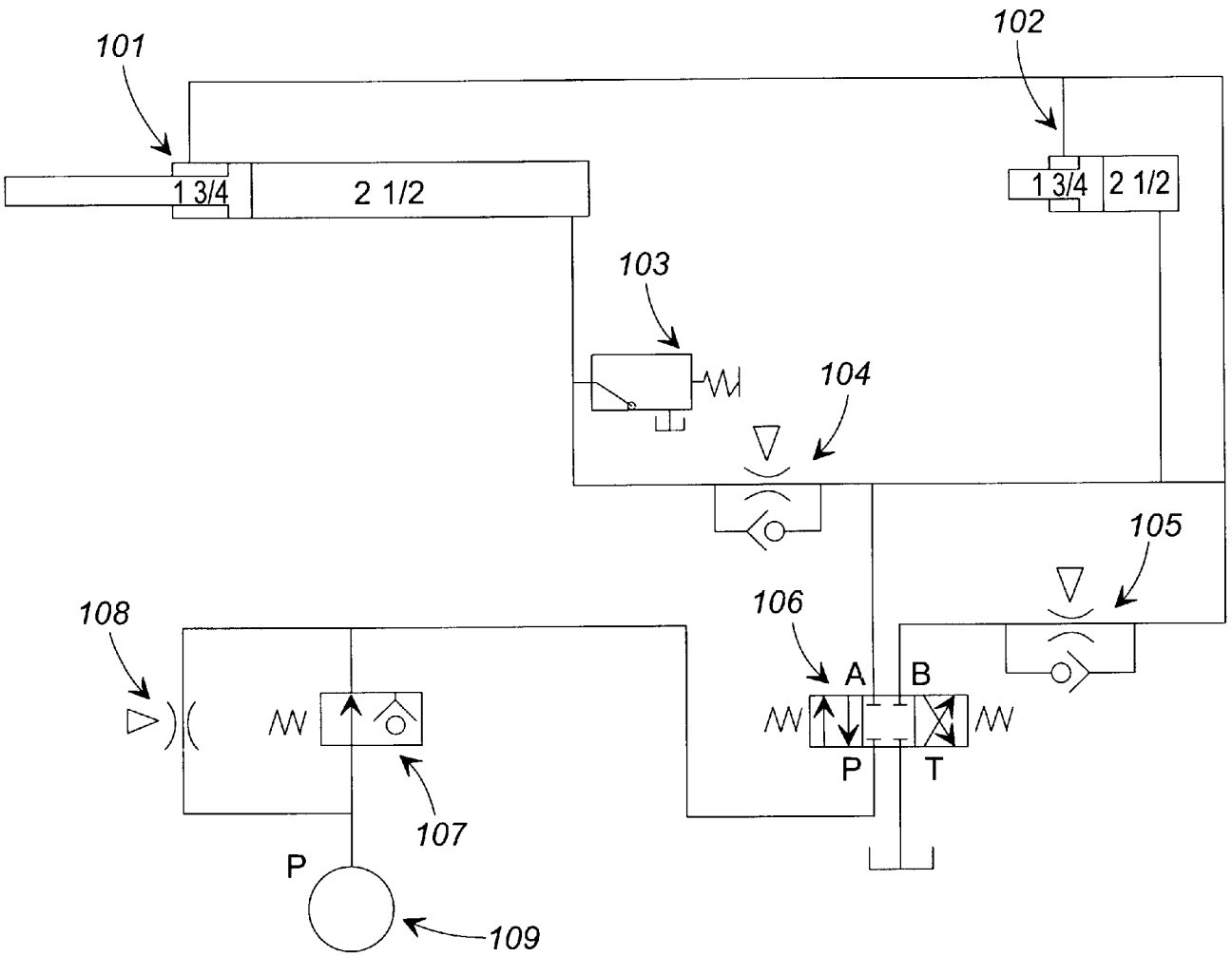
FIG. 15 is a hydraulic system illustrative drawing.

Assuming the system of FIGS. 9A-9B, reference is now made to the elements of FIG. 15.

Hydraulic cylinder 101 is connected to and is configured to move the lower pusher plate 60.

Hydraulic cylinder 102 (with cushions at both ends) is connected to and is configured to move the tipper plate 90.

Relief valve 103 is used to relieve excessive hydraulic oil pressure allowing the hydraulic cylinder 101 to retract if impact occurs to plate 60.

Adjustable flow control 104 controls speed of the stroke of plate 60 when pushing "lilypads" or other material toward cutting drum 11 and will still give full flow of hydraulic oil to cylinder 102 allowing the tipper plate 90 to move forward at high speed.

Adjustable flow control 105 controls the retracting speed of plate 60 and tipper plate 90.

Electric solenoid operated hydraulic valve 106 controls cylinders 101 and 102. Solenoid operated hydraulic valve to detour hydraulic oil to flow control valve 108.

An adjustable flow control valve 108 is provided. Valves 108 and 107, when activated, will restrict flow from the hydraulic pump and act as a decelerating valve for hydraulic cylinder 101. Valves 108 and 107 will be controlled by a limit switch mounted a distance from the end of the return stroke of pusher plate 60. A variable displacement pressure compensated hydraulic pump 109 is provided the energize the overall system.

Controls

Figure 16:
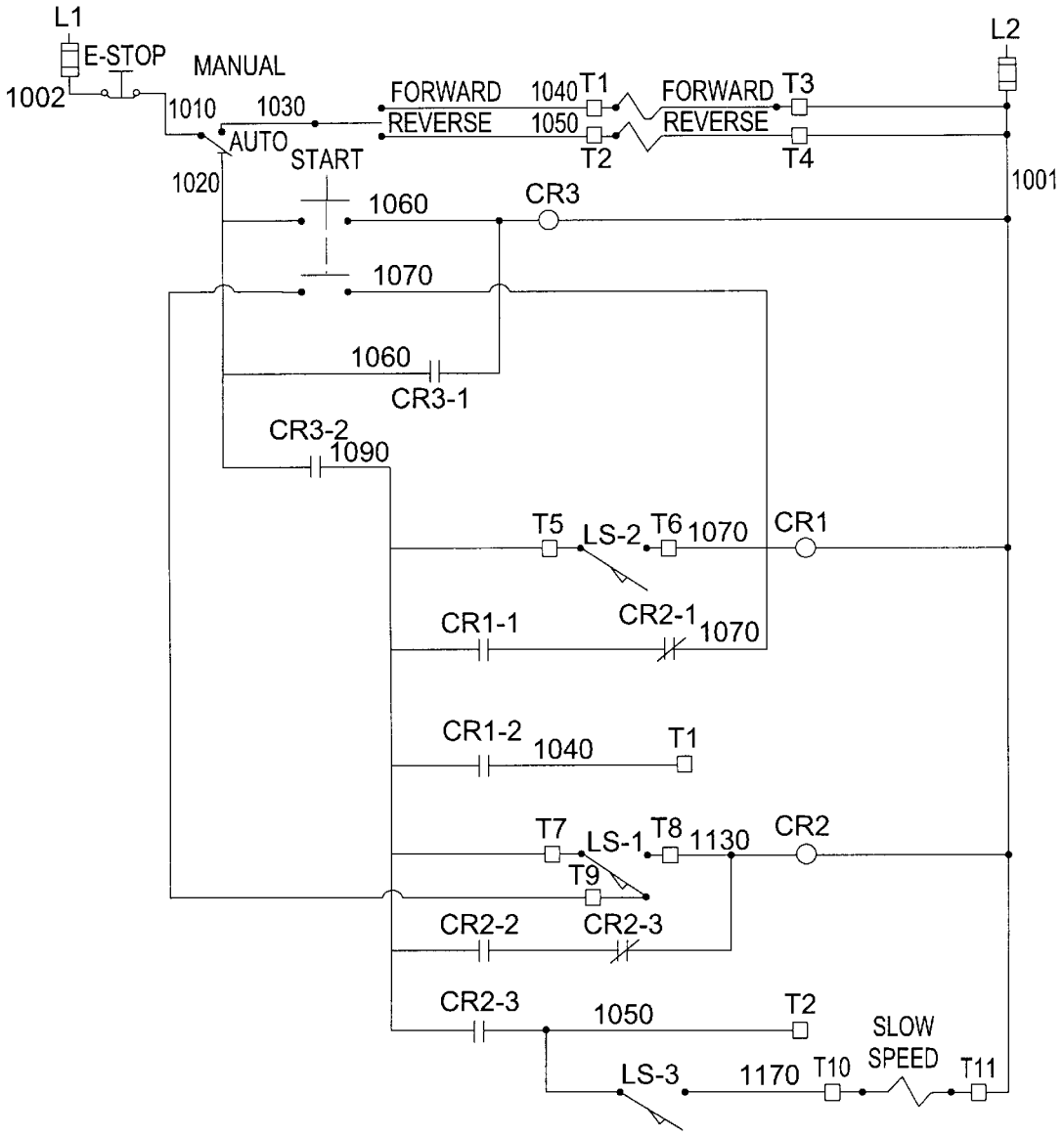
FIG. 16 is an electrical schematic drawing.

Reference is now made to FIG. 16, to describe controls used with the configuration of FIGS. 9A-9B.

For controls one can use PLC with limit switches, pressure switches and amperage sensors on the drive motors to control feed rates, all safety plugs and emergency stop buttons.

Reference is now made to FIG. 16. As may be seen, this electrical Schematic allows switching between manual (to cycle feed plates with a manual switch) to automatic to energize an automatic feed system.

When in the position shown in FIG. 16, Line 1020 is hot. Momentary contact of start switch will energize 1060 which will energize solenoid coil CR3 and close CR3-1 and CR3-2 energizing line 1090. Power will then go through LS1 and to the second level of the start switch.

The initial engagement of the start will energize 1070 and energize CR1 and will close CR1-1 and CR1-2, energizing 1040 and T1. This will energize the valve to move the feed plates forward.

When the feed plates are all the way forward, LS1 will engage and energize line 1130 and CR2 which will drop out CR2-1 de-energizing CR1 and will drop out CR1-1 and CR1-2 to 1040 and T1. CR2-3 is now closed energizing 1050 and T2 which will energize the 4 way valve to reverse the Feed Plates. LS3 will energize the decelerating valve near the end of the reverse stroke.

When the Feed Plates reach the reverse end of the stroke LS-2 will close, energizing CR-1, closing CR1-1, opening CR1-3, which will de-energize CR-2, closing CR2-1 closing CR1-2 to 1040 and T1 causing the Feed Plates to move forward and continue to Cycle.

Therefore it may be seen that when the LS1 switch is triggered, the pusher plates go into reverse. When hit LS2 is triggered, they go forward. When they hit LS3, they slow down.

Dimensions and Specifications

As shown in FIG. 11, the pusher plates (the lower pusher plate 60 is shown) in one embodiment include a steel portion 44, 2 inches thick, with a 1 inch solid "wear plate" 46 of nylon bearing material attached underneath, and two 1 inch by 2 inch side bearing strips 48 running the length of the lower pusher plate 60. A ¾ inch steel floor is used.

The system is a "3000 lb" system capable of a 3000 lb pushing force and 52" pushing stroke, used in conjunction with a cutting drum of 50" diameter and driven at approximately 210 RPM by a 100 HP motor, although at the time of filing that was thought to be possibly too much HP.

It should be understood that other alternate configurations having different sizes, rates, and power capabilities could also be used without departing from the spirit scope of the present invention.

Alternate Configurations

In the present invention, it has been noted that the weight of the upper pushing plate 40 tends to cause it to be frictionally engaged atop the lower pusher plate 60 to cause such friction to pull the upper member back simultaneously with the lower pusher plate 60 as the lower pusher plate 60 is retracted relative to the frame. However, a stop attached to the lower member which engages the upper member may also be used in case the upper member tends to bind along its sliding path.

Alternately, a hog may be used. If a hog is used, anvil members may also be provided along the wall where wood may be drawn.

The 9 inch upper plate overhang of the embodiments show can be different depending on material diameters. The pushers can also be different thicknesses depending on the average material size.

Instead of a long tipper plate such as shown in FIG. 5A-B, a shorter tipper plate (not shown) could be used which would only extend out partly towards the cutting drum (for example 1–2 feet from the edge of the infeed sloping member), to "kick" over lilypads which may remain on edge.

The feed rate is controllable by the speed of the pusher plate, and can be varied as desired for different material thicknesses. However, one configuration it has been found that for ¼" thickness chips, with a "dual-flight" cutter confirmation (two cuts per revolution), a feed speed of ½' per revolution is appropriate. It should be understood that some field adjustments as known in the wood chipping art are always possible; if excessive power consumption or "smoking" is occurring, the feed rate or pressure may be reduced, or if the chips are too thin the feed rate or pressure may be increased.

An additional hydraulic cylinder could also be used intermediate the upper and lower pusher plates if relative movement or a "dampening" effect is desired which is not provided by the frictional contact shown.

Instead of plastic bearing plates, wheels rollers or rails could also be used.

Instead of using hydraulics to push or pull the plates, chains, cable, or lead screws could also be used.

The concept of a contained cavity noted above could also be used with a horizontal chipper.

Figure 18:
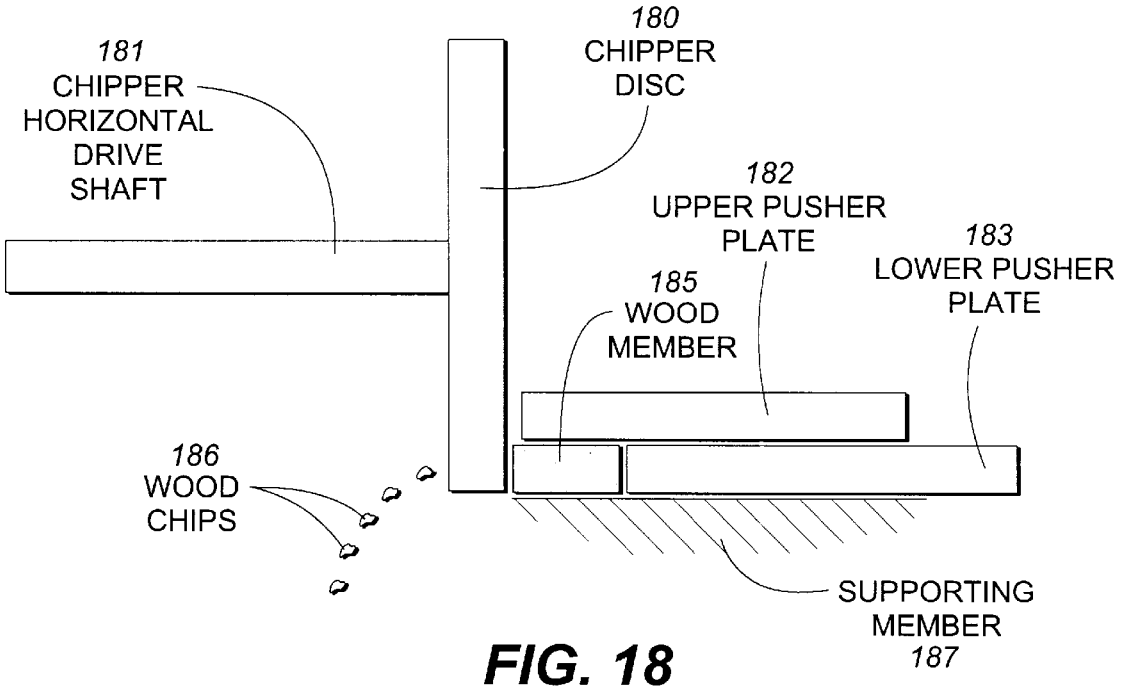
FIG. 18 is a side plan illustrative view of an alternate embodiment of the present invention, including a chipper disc 180 with a horizontal drive shaft 181, and upper and lower pusher plates 182, 183, with "square" pushing faces.

As shown in FIG. 18, a chipper disc 180 (having a vertical face) mounted to a horizontal drive shaft 181 (rotating about a horizontal axis) can be fed along the top of a supporting member 187 by a pair of pusher plates 182, 183, (similar to those previously discussed but having "square" pushing faces), such that a wood member 185 (shown captured in a substantially closed cavity) can be turned into wood chips 186. The knifes on the disc 180 can be as known in the art or as shown previously, and oriented to provide an optimal chip.

Power Requirements

It has also been found that power requirements for cutting with present vertical axis chipper configuration is less than prior art configurations such as shown in FIG. 17. As shown in FIG. 17, the prior art configurations include a horizontal chipper spout which includes a wedging action against the drum to keep the wood stable while being chipped. However, such as configuration causes friction, heat, and wear, and uses excessive power.

In contrast, the pusher plates on the chipper of the present invention do not depend on wedging, and thus provide a more consistent wood chip. In contrast, the blocks are held by toothlike points and the pusher plate(s) are moved toward the drum at a controlled speed and no wedging is required. A further power saving feature could be the use of an amperage sensor on the motor which would slow or stop the pusher plate until the amperage decreases, followed by more of the pushing action. This "stop and go" feed motion is further facilitated by the design of the one apparatus according to the present invention, which does not depend on gravity for feeding purposes. If feed needs to be stopped, the pusher(s) are simply stopped and there are no wood members which are in a gravity-fed hopper which must still be consumed.

Miscellaneous Comments

The apparatus 10 according to the present invention is believed to have good possibilities for the medium to large production mills. The lower knives will likely do most of the work. For the larger, higher production mills, the lower pushers may be stacked. The bottom one would forward first, then the one above it moves forward until all pushers are forward. Then all pushers retract at one time and start the cycle over again. This does two things, increases production and distributes wood over more of the working area of the drum, utilizing more knives. The basic idea is that the wood material can be dropped into the hopper from a conveyor and will tend to be oriented when hitting the top of the pusher or the bottom of the hopper.

Conclusion

Therefore it may be seen that the present invention overcomes deficiencies in the prior art by providing a method and apparatus for handling bulk quantities of lilypads, which will process the lilypad members in an efficient yet effective manner, providing wood chips having desirable characteristics.

While this invention has been described in specific detail with reference to the disclosed embodiments, it will be understood that many variations and modifications may be effected within the spirit and scope of the invention as described in the appended claims.

What is claimed is:

1. An apparatus for reducing the size of a wood member, said apparatus comprising:

a stationary supporting member for supporting said wood member;

a cutting member movable relative to said stationary supporting member for cutting said wood member while said wood member is supported by said supporting member;

a platelike pushing member movable relative to said stationary supporting member and said cutting member for pushing said wood member towards said cutting member across said supporting member so that it can be cut; and a platelike containing member movable relative to both said pushing member and said supporting member, said containing member movable from a first to a second position, said containing member when in said first position being clear of a wood member insertion path allowing at least a portion of said wood member to be placed intermediate said pusher member and said cutting member, said containing member when in said second position blocking said insertion path, wherein said containing member moves in tandem with said pushing member through a portion of the paths of movement of said containing member and said pushing member.

2. The apparatus as claimed in claim 1, wherein said containing member rides atop said pushing member through a portion of the paths of movement of said containing member and said pushing member and is maintained there at least in part by friction.

3. The apparatus as claimed in claim 2, wherein said containing member and said pushing member move along reciprocating linear paths.

4. The apparatus as claimed in claim 3, wherein said containing member and said pushing member are platelike.

5. The apparatus as claimed in claim 4, wherein said containing member moves in tandem with said pushing member through a portion of the paths of movement of said containing member and said pushing member.

6. The apparatus as claimed in claim 5, wherein sad containing member rides atop said pushing member throughout through a portion of the paths of movement of said containing member and said pushing member and is maintained there at least in part by friction.

7. The apparatus as claimed in claim 6, wherein said containing member and said pushing member move along reciprocating linear paths.

8. An apparatus for reducing the size of a wood member, said apparatus comprising:

a stationary supporting member for supporting said wood member;

a cutting member movable relative to said stationary supporting member for cutting said wood member while said wood member is supported by said supporting member, wherein said cutting member is a cutting drum including cutting knives thereon;

a first pushing plate movable along a path relative to said stationary supporting member and said cutting member for pushing said wood member across said stationary supporting member towards said cutting member so that it can be cut, wherein said first pushing plate includes an arcuate pushing face configured to conform at least partially to the circumferential surface of said cutting drum; and a second pushing plate movable along a path relative to both said stationary supporting member and said first pushing plate, said containing member movable from a first to a second position, said first position being clear of a wood member insertion path for allowing at least a portion of said wood member to be placed intermediate said pusher member, said cutting member when in said second position blocking said insertion path, wherein said second pushing plate includes an arcuate pushing face configured to conform at least partially to the circumferential surface of said cutting drum, said first and second pushing plates configured to move such that said second pushing plate leads said first pushing plate through at least a portion of its path, such that said second pushing plate overhangs said first pushing plate such that an open cavity is defined between said stationary supporting member and said first and second pushing plates, said cavity directed towards said cutting member and said cavity being moved towards said cutting member as said first and second pushing plates move along a portion of their moving paths.

9. An apparatus for reducing the size of wood members as claimed in claim 8, wherein said arcuate pushing face of said first pushing plate includes wood engaging spikes.

10. An apparatus for reducing the size of wood members as claimed in claim 9, wherein said arcuate pushing face of said second pushing plate includes wood engaging spikes.

11. An apparatus for processing disklike wood elements having a cylindrical length shorter than their cylindrical diameter and a grain running along said cylindrical length, said apparatus comprising:

a substantially horizontal supporting surface;

a cutting drum having cutting knives thereon, said cutting drum being rotatable about a substantially vertical rotational axis; and a platelike pusher member for pushing said disklike wood elements across said substantially horizontal supporting surface and towards said cutting drum, said platelike pusher member including an arcuate pushing face configured to conform at least partially to the circumferential surface of said cutting drum, and a platelike movable containing member including an arcuate pushing face configured to conform at least partially to the circumferential surface of said cutting drum, said movable containing member being movable relative to said platelike pusher member, said containing member movable from a first to a second position said first position providing a path for allowing at least a portion of said wood member to be placed intermediate said pusher member and said cutting member, such that the grain of said disklike wood elements is substantially parallel to said drum rotation axis when consumed by said drum.

12. An apparatus for reducing the size of a wood member, said apparatus comprising:

a stationary supporting member for supporting said wood member;

a cutting drum for cutting said wood member while said wood member is supported by said supporting member;

a pushing plate including an arcuate leading pushing face, said pushing plate movable relative to said stationary supporting member and said cutting member for pushing said wood member towards said cutting member so that it can be cut; and a plurality of wood engaging spikes extending from said arcuate leading pushing face of said pushing plate for engaging said wood member while being cut by said cutting drum.

13. An apparatus for reducing the size of wood members as claimed in claim 12, further comprising a second pushing plate movable along a path relative to said stationary supporting member and said first pushing plate, said containing member movable from a first to a second position, said first position providing a wood member insertion path for allowing at least a portion of said wood member to be placed intermediate said pusher member and said cutting member and said second position blocking said insertion path.

14. An apparatus for reducing the size of wood members as claimed in claim 12, wherein said arcuate pushing face of said second pushing plate includes wood engaging spikes.

15. The apparatus as claimed in claim 13, wherein said containing member and said pushing member are platelike.

16. An apparatus for reducing the size of wood members as claimed in claim 15, wherein said arcuate pushing face of said second pushing plate includes wood engaging spikes.

17. A method for processing a disklike wood "lilypad" member with a cutting drum rotating about a rotation axis, said lilypad member having an average grain fiber length less that its diameter, said method comprising the steps of:

containing said lilypad member in an orientation with the grain of the lilypad member being substantially parallel to said drum rotation axis; and cutting said lilypad members with said cutting drum while maintaining said lilypad member in said orientation.

18. The method for processing a lilypad member as claimed in claim 17, said method including the step of engaging said lilypad member with spikes at least during a portion of the cutting process.

19. A method for processing disklike wood "lilypad" members, each lilypad member having an average grain fiber length less that its diameter, said method comprising the steps of:

dropping said lilypad members atop a supporting surface;

tipping a portion of said lilypad members to a more stable position;

containing said lilypad members within a cavity defined in part by a cutting drum; and cutting said lilypad members with said cutting drum rotating about a drum rotation axis, with the grain of the lilypad members being substantially parallel to said drum rotation axis.

20. A method for processing disklike pad members including end faces, each lilypad member having an average grain fiber length less that its diameter, said method the steps of:

A) dropping said lilypad members atop a supporting surface such that the end face of at least one of said lilypad members is in contact with said supporting surface;

B) engaging at least one of said lilypad member with an engaging spike; and

C) simultaneous with step "B", cutting said lilypad members with said cutting drum rotating about a drum rotation axis, with the grain of the lilypad members being substantially parallel to said drum rotation axis.

21. An apparatus for reducing the size of a wood member, said apparatus comprising:

a stationary supporting member for supporting said wood member;

a cutting member movable relative to said stationary supporting member for cutting said wood member while said wood member is supported by said supporting member, said cutting member including a drum having a vertical rotational axis;

a pushing member movable relative to said stationary supporting member and said cutting member for pushing said wood member towards said cutting member across said supporting member so that it can be cut; and a containing member movable relative to both said pushing member and said supporting member, said containing member movable from a first to a second position, said containing member when in said first position being clear of a wood member insertion path allowing at least a portion of said wood member to be placed intermediate said pusher member and said cutting member, said containing member when in said second position blocking said insertion path.

22. An apparatus for reducing the size of a wood member, said apparatus comprising:

a stationary supporting member for supporting said wood member;

a cutting member movable relative to said stationary supporting member for cutting said wood member while said wood member is supported by said supporting member, wherein said cutting member is a cutting drum including cutting knives thereon;

a first pushing plate movable along a path relative to said stationary supporting member and said cutting member for pushing said wood member across said stationary supporting member towards said cutting member so that it can be cut; and a second pushing plate movable along a path relative to both said stationary supporting member and said first pushing plate, said containing member movable from a first to a second position, said first position being clear of a wood member insertion path for allowing at least a portion of said wood member to be placed intermediate said pusher member, said cutting member when in said second position blocking said insertion path, wherein said second pushing plate includes an arcuate pushing face configured to conform at least partially to the circumferential surface of said cutting drum, said first and second pushing plates configured to move such that said second pushing plate leads said first pushing plate through at least a portion of its path, such that said second pushing plate overhangs said first pushing plate such that an open cavity is defined between said stationary supporting member and said fist and second pushing plates, said cavity directed towards said cutting member and said cavity being moved towards said cutting member as said first and second pushing plates move along a portion of their moving paths.

23. An apparatus for reducing the size of wood members as claimed in claim 22, wherein said arcuate pushing face of said first pushing plate includes wood engaging spikes.

24. An apparatus for reducing the size of wood members as claimed in claim 23, wherein said arcuate pushing face of said second pushing plate includes wood engaging spikes.

* * * * *